United States Patent [19]

Poling

[11] Patent Number: 4,632,462

[45] Date of Patent: Dec. 30, 1986

[54] CONTINUOUS MINER-MOUNTED MINE VENTILATION SYSTEM

[75] Inventor: William M. Poling, Price, Utah

[73] Assignee: Atlantic Richfield Company, Los Angeles, Calif.

[21] Appl. No.: 634,515

[22] Filed: Jul. 26, 1984

[51] Int. Cl.[4] ..... E21C 35/22

[52] U.S. Cl. ..... 299/12; 299/81; 98/50

[58] Field of Search ..... 299/64, 76, 81, 12; 98/50

[56] References Cited

U.S. PATENT DOCUMENTS 3,333,896 8/1967 Diamanti ..... 98/50 X 4,157,204 6/1979 Kissell et al. ..... 299/64

OTHER PUBLICATIONS

Ruggieri, Steven K., "Sprayfan System–Installation and Operation Manual–vol. II," Oct. 1981.

*Primary Examiner*—Stephen J. Novosad

*Assistant Examiner*—Thomas J. Odar

*Attorney, Agent, or Firm*—F. Lindsey Scott

[57] ABSTRACT

In a continuous mining machine equipped with a sprayfan ventilation system for methane and dust control, the sprayfan ventilation system including a plurality of sprayfans positioned on the front portion of the mining machine to direct intake air to and across the front of the mining machine to prevent buildup of methane and dust concentrations, the intake air containing methane and dust being thereafter discharged to an exhaust zone, an improvement comprising: at least one reverse sprayfan means mounted on a rear portion of the mining machine on a side of said mining machine nearest the exhaust zone and positioned to direct spray to the rear of the mining machine and to direct said intake air containing methane and dust generally toward the exhaust zone.

21 Claims, 11 Drawing Figures

CONTINUOUS MINER-MOUNTED MINE VENTILATION SYSTEM

This invention relates to an improved sprayfan system.

In various mining operations, particularly coal mining operations, continuous mining machines are used. Such continuous mining machines are well known to the art and generally comprise a mobile body, which supports an elevatable boom, which supports a rotatable cutter head comprising a drum bearing cutter bits which dislodge coal from coal seams for collection and loading onto a shuttle car or other coal conveying device. The machines may also include ripper chains and the like. Such machines are well known to the art.

In the use of such machines to remove coal from subterranean coal seams, the coal is typically removed from tunnels which are generally about twice the width of the mining machine. The tunnels are generally of a height representing substantially the depth of the seam which can be effectively removed as a coal product. In the practice of such mining techniques, Section 75.302-1(a) 30 C.F.R. requires that the line brattice or ventilation tubing be not more than ten feet from the area of deepest penetration to which any portion of the mining machine or mining face has been advanced. Under certain conditions this distance can be extended by the appropriate regulatory agency. The reference to line brattice or ventilation tubing refers to a system whereby an exhaust zone is established near one side or the other of the mine tunnel leading to the mining area. Such an exhaust system is typically formed by positioning a curtain near one side of the mine and providing means for exhausting air from the mining zone through the curtained off area. The net effect is that clean (intake) air moves through the zone of the tunnel leading to the mining area up to the mine face and then back into the exhaust zone defined by the curtain, exhaust tubing or the like. This method of ventilation results in a zone of relatively clean air in which operations in support of the mining machine may be conducted.

A sprayfan system developed by Foster-Miller Associates, Inc. under a contract with the United States Department of the Interior, Bureau of Mines, has been found effective to achieve suitable ventilation at distances of up to twenty feet from the exhaust zone. This system is described in a report entitled "Sprayfan System—Installation and Operation Manual—Volume II", Contract HO230023 dated October, 1981 and provided to the United States Department of the Interior, Bureau of Mines by Foster-Miller Associates, Inc. (herein the Bureau of Mines Report). The sprayfan auxilliary ventilation system is a water spray system supported on a continuous mining machine which "directs intake air to and across the front of a continuous mining machine to prevent build up of methane gas and dust concentrations". This system has been found to be effective as described in the Bureau of Mines Report. The system is much more effective than water spray systems used previously. As known to those skilled in the art, it is necessary to use a water spray on the cutter drum for a variety of reasons. The water spray is necessary to cool the cutter bits, to minimize dusting, to lubricate the cutter bits and the like as well known to those skilled in the art. Such sprays have typically been randomly arranged to effectively spray the cutter drum. In the discussion of mining machines in this application, the term "cutter drums" will be used generally to refer not only to cutter drums but also to mining machines which may include ripper chains and the like. The effectiveness of the sprayfan ventilation system is not considered to be dependent upon the particular configuration of the cutting apparatus used in the particular mining machine. Various data relating to the effectiveness of the sprayfan system discussed in the previously noted Bureau of Mines Report as compared to conventional spray systems is presented in a memorandum to John Volkwine, Technical Project Officer, United States Bureau of Mines, from Stephen K. Rugerey, Program Manager, Foster-Miller, Inc., dated Sept. 15, 1983.

It is desirable for safety that effective methane and dust control be accomplished in the mining zone. It is also highly desirable economically that the distance beyond the exhaust zone to which the continuous mining machine can advance without the necessity for advancing the exhaust zone be optimized. Such an improvement would obviously result in improved efficiency as well as improved safety in the mine environment.

It has now been found that the distance to which the miner can safely advance is extended by an improvement in a continuous mining machine equipped with a sprayfan ventilation system for methane and dust control. The sprayfan ventilation system includes a plurality of sprayfans positioned on the front portion of the mining machine to direct intake air to and across the front of the mining machine to prevent buildup of methane and dust concentrations with the intake air containing methane and dust being thereafter discharged to an exhaust zone. The improvement comprises: at least one reverse sprayfan means mounted on a rear portion of the mining machine on a side of the mining machine nearest the exhaust zone and positioned to direct spray to the rear of the mining machine and to direct the intake air containing methane and dust generally toward the exhaust zone.

In the description of the subject invention, the same numbers will be used to refer to the same or similar components throughout.

Figure 1:
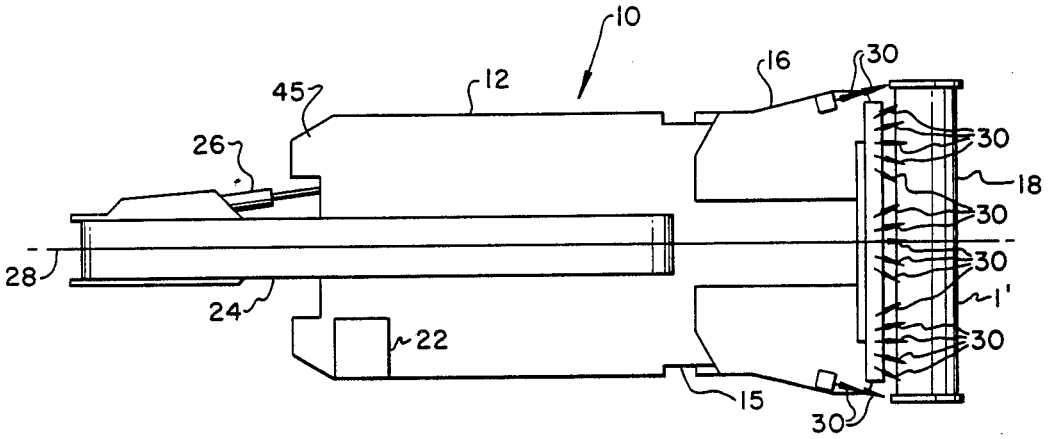
FIG. 1 (PRIOR ART)
FIG. 1 is a schematic diagram of a mining machine including prior art water sprays positioned to spray the cutter drum.

As indicated previously, continuous mining machines are considered to be well known to those skilled in the art. Such a machine is shown in FIG. 1. The mining machine 10 comprises a body 12 which has positioned on its front end 15 an elevatable boom 16 which supports a cutter head 18 which is elevatable to mine coal seams of varying thicknesses. Cutter head 18 has not been shown in detail since cutter heads are well known to those skilled in the art and include both drum type and ripper chain type cutting heads. Cutter head 18 is sprayed by a plurality of water sprays 30 to cool and lubricate the cutter bits in cutter head 18. In the operation of such mining machines, the machine is advanced with cutter head 18 rotating to engage a coal face with the coal then being dislodged from the coal face by the cutter bits so that it falls to the mine floor where it is gathered into a gathering head 20 (shown in FIG. 5) and passed via a conveyor 24 to a coal haulage device (not shown). Conveyor 24 is typically moveable relative to a longitudinal axis 28 of mining machine 10 by a controller 26 shown as a hydraulic ram. While an operator's compartment 22 is shown, many such mining machines are remotely controlled. In such operations, a tunnel generally about twice the width of cutter head 18 is mined through the coal seam with crossing tunnels then being mined to leave pillars or square zones of coal still in place. As the mine develops, this network of tunnels is expanded into the coal seam. After the mine zone has been developed in this fashion the pillars are removed by means known to those skilled in the art to produce additional coal as a withdrawal is made from the mined zone. As continuous mining machine 10 advances, the distance by which the continuous mining machine 10 can advance has been controlled by regulation to a distance of no more than ten feet beyond the exhaust zone. The exhaust zone has been and typically is formed by positioning a curtain or other space dividing means near one side of the tunnel leading to the mine face. An exhaust means such as a ventilating line or the like is then positioned behind the curtain to withdraw air from the mine face zone as mining occurs. The main portion of the tunnel leading to the mine face is thus subject to an intake air flow toward the mine face so that operations in support of the continuous mining machine are conducted in a clean air zone. The methane and dust resulting from mining operations are collected in the air flowing toward and across the mine face and then into the exhaust zone. Typically, the mine roof is bolted as necessary up to the maximum advance of the curtain zone. Thus, support operations can be conducted in a roof bolted clean air zone.

Figure 2:
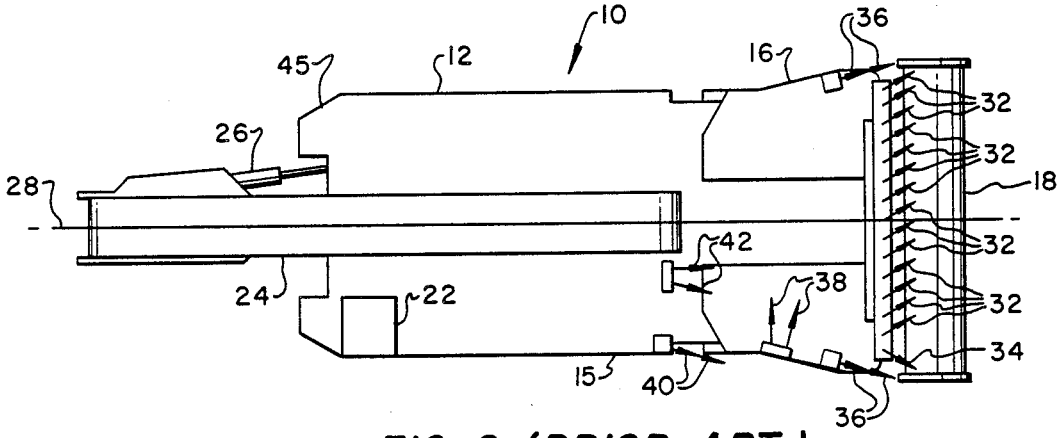
FIG. 2 (PRIOR ART)
FIG. 2 is a schematic diagram of a mining machine equiped with a prior art sprayfan system.

As discussed in the Bureau of Mines Report, the distance by which the continuous miner can advance beyond the exhaust zone has been extended by the use of a sprayfan system. An embodiment of this sprayfan system is shown in FIG. 2. The term sprayfan is used to refer to water sprays which comprise a nozzle and appropriate supporting plumbing to produce a water spray in a generally cone shaped pattern. Such sprays have been effective to move air to improve ventilation as discussed herein and in the Bureau of Mines Report. Sprayfans 32 are shown positioned to spray upon cutter head 18 but also oriented to cause a flow of air to and across the mine face and cutter head 18. Sprays 34 and 36 are oriented as shown to spray toward the ends of cutter head 18. Additional sprays 38, 40 and 42 are oriented to faciliate the flow of intake air to and across cutter head 18 during mining operations. This system has been found to be effective as indicated in the Bureau of Mines Report to such an extent that the continuous mining machine may advance to a distance of twenty feet beyond the exhaust zone with no degradation in the methane and dust concentrations in the mining zone.

Figure 3:
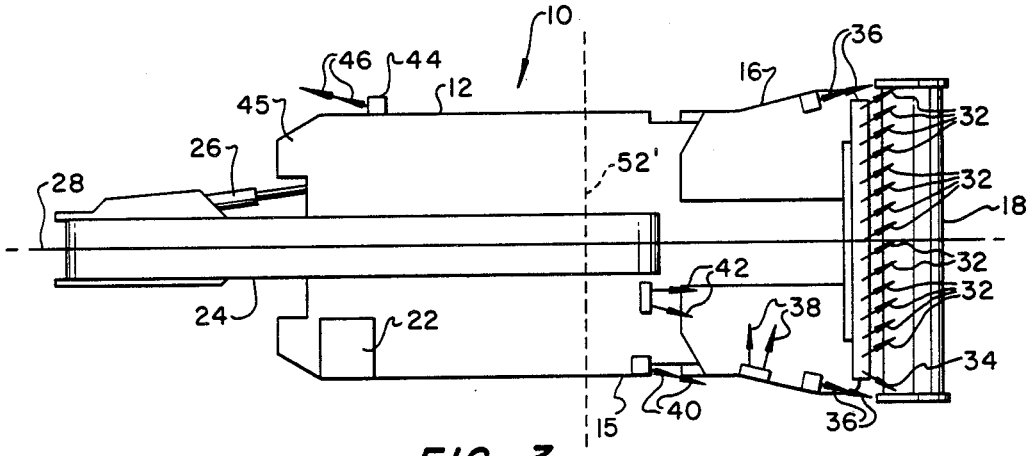
FIG. 3 is a schematic diagram of a mining machine equipped with a sprayfan system and a reverse spray on a rear portion of the continuous mining machine according to the present invention.

In FIG. 3, an embodiment of the present invention is shown. The configuration of the mining machine shown in front of dotted line 52 generally comprises the sprayfan system described in the Bureau of Mines Report. By the improvement of the present invention, a reverse sprayfan 46 is positioned in a spray block 44 on a rear portion 45 of mining machine 10. It has been found that intake air which has passed near the mine face and now contains quantities of methane and dust is exhausted more efficiently by the use of reverse sprayfan 46 to such an extent that the distance beyond the exhaust zone to which the continuous mining machine can safely advance can be extended beyond twenty feet. Desirably, a plurality of reverse sprayfans 46 are positioned in spray block 44, as will be described further below.

Figure 4:
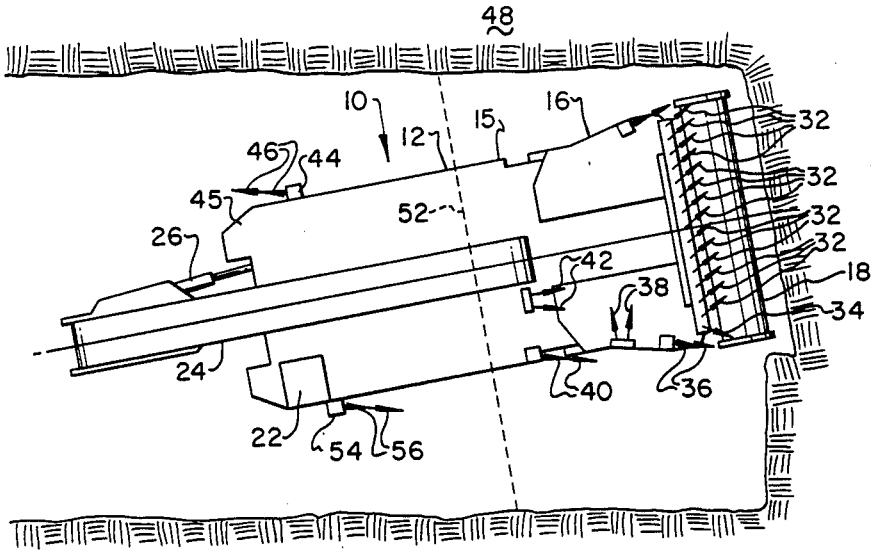
FIG. 4 is a schematic diagram of a mining machine positioned in a mine tunnel and including a sprayfan system, a reverse spray and a forward spray according to the present invention.

In FIG. 4, a further embodiment of the improvement of the present invention is shown. A continuous mining machine 10 is shown in place in a mine opening in a coal seam 48 and includes, in addition to reverse sprayfans 46, additional forward sprayfans 56 positioned in a spray block 54. Both spray blocks 44 and 54 are desirably positioned as far back as practical on body 12 of mining machine 10. The orientation of sprayfans 46 and 56 will be described in more detail below.

Figure 5:
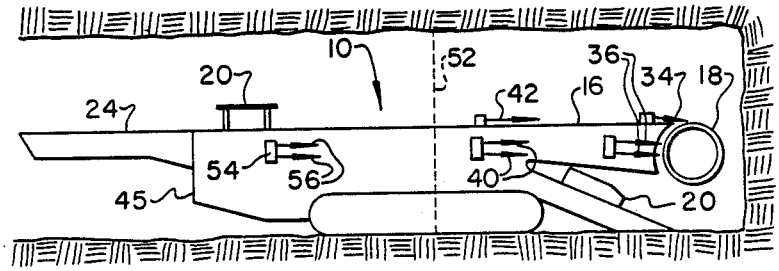
FIG. 5 is a side view of the mining machine of FIG. 4.

FIG. 5 is a side view of the mining machine shown in FIG. 4.

Figure 6:
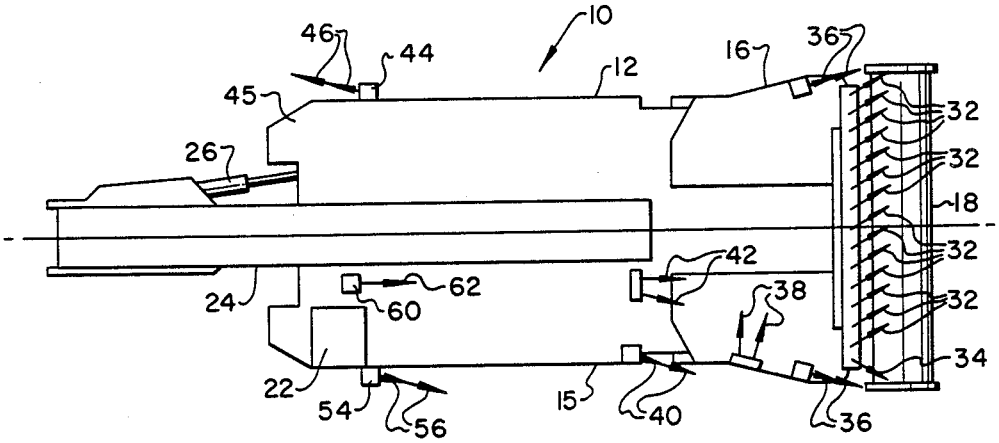
FIG. 6 is a schematic diagram of a continuous mining machine including a further embodiment of the improvement of the present invention.

In FIG. 6 a further embodiment of the improvement of the present invention is shown and comprises a cab spray 62 positioned in a spray block 60 on the top of mining machine 10.

Sprayfans useful in the practice of the present invention are known to those skilled in the art and the improvement of the present invention is accomplished primarily as a result of the location and orientation of the sprayfans. Various sprayfans which are effective in the practice of the present invention have been described in the Bureau of Mines Report.

Figure 7:
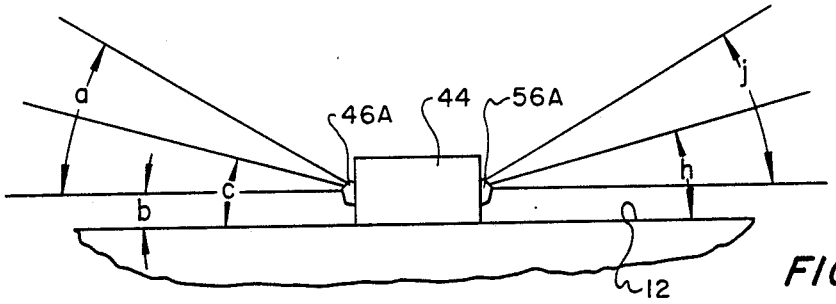
FIG. 7 is a top view of a spray block showing the orientation of a forward and a reverse sprayfan.

FIG. 7 is a top view of spray block 44. Spray block 44 desirably includes two sets of reverse sprayfans—sprayfans 46A and 46C and sprayfans 46B and 46D shown in FIG. 8. Two sprayfans are desirably included in each set for purposes of reliability and to give a wider spray coverage to improve the air handling capability of the sprayfan system. The reverse sprayfans may have a spray angle from about 10° to about 45° shown as angle a in FIG. 7. Desirably reverse sprayfans 46A and 46C are oriented so that the side of the spray pattern nearest mining machine body 12 is at an angle b from about 0° to about 10° from the side of body 12. In the discussion of the angle of orientation of sprayfans herein, reference will be made to the central axis of the sprayfan pattern. Sprayfans 46A and 46B are at an angle c from about 5° to about 25° from the side of body 12, as shown in FIG. 7. Desirably sprayfan 46A is at an angle d from about 5° to about 25° above horizontal and sprayfan 46C is at an angle m from about 5° to about 25° below horizontal.

This orientation of reverse sprayfans is suitable for operations where the continuous mining machine is on the exhaust zone side of the mine opening.

Figure 8:
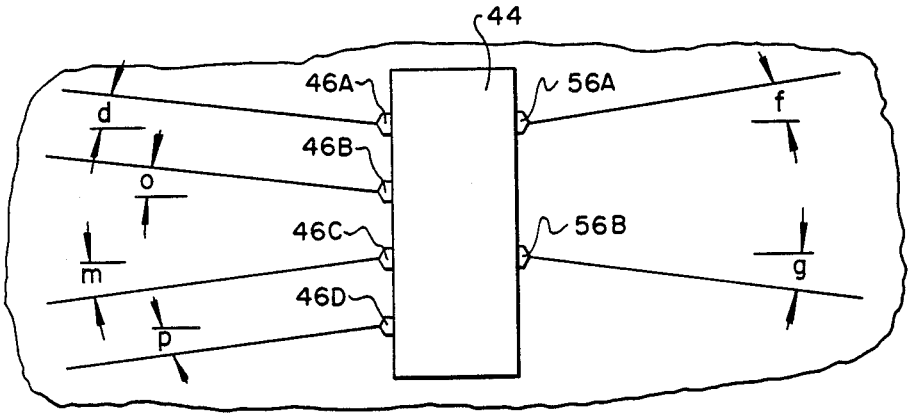
FIG. 8 is a side view of a spray block showing the orientation of various sprayfans.
Figure 9:
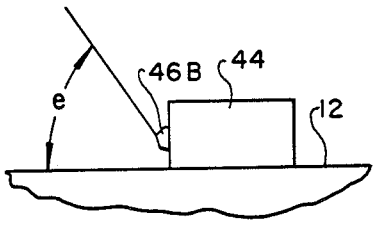
FIG. 9 is a schematic diagram of the spray block of FIG. 7 showing the orientation of an additional sprayfan.

When the exhaust zone is on the opposite side of the mine opening from the mining machine then an alternate set of reverse sprays 46B and 46D are engaged. Sprays 46B and 46D are at an angle e shown in FIG. 9 from about 40° to about 50° from the side of body 12. Sprayfan 46B is generally oriented at an elevation above horizontal shown as angle o, from about 5° to about 25° and sprayfan 46D is at an angle p from about 5° to about 25° below horizontal. In the event that the mining machine is to be used with a curtain or exhaust area on either or alternate sides of the mine, then a spray block 44 should be positioned on each side of the mining machine for use as required to achieve a reverse spray from the side of the mining machine nearest the exhaust zone. In such instances, a spray block 54, including forward sprays 56, should also be positioned on each side of the mining machine. In such instances, the proper sprays can be activated to achieve the desired reverse spray on the exhaust zone side of the machine and the desired forward spray on the opposite side of the machine. Such an embodiment is shown in FIGS. 7 and 8. While the reverse sprayfans 46A, 46B, 46C and 46D and forward sprayfans 56A and 56B are shown in a common spray block, separate spray blocks can be used. Forward sprayfan 56A is oriented at an angle f from about 5° to about 25° above horizontal with a second forward sprayfan 56B being oriented at an angle g from about 5° to about 25° below horizontal as shown in FIG. 8. In FIG. 7 the orientation of spray 56A is shown. Spray 56A is oriented at an angle h from about 5° to about 25° from the side of body 12. Sprayfan 56A may be a spray having an angle j from about 10° to about 45°.

While only sprays 46A and 56A of the sets of sprays comprising 46A and 46C, and 56A and 56B respectively, have been shown in FIG. 7, it is desirable that both sprays of the set be at about the same angle from side 12, i.e., angle c and angle h respectively.

It is desirable that a spray block containing both reverse and forward sprays be located on each side of mining machine 10 when the exhaust zone is to be located on either or an alternating side of the mine opening. If the curtain or exhaust zone is to be positioned in all cases on either side of the mine opening it is suitable to use only a reverse spray on the side nearest the curtain or exhaust zone and only a forward spray on the opposite side of the machine. Even in such instances, it is still desirable to have two sets of reverse sprays on the side of mining machine 10 nearest the curtain or exhaust zone so that the higher angle sprays can be used when mining machine 10 is operating on the side of the mine opening opposite the curtain or exhaust zone with the lower angle sprays being used when mining machine 10 is operating on the exhaust zone side of the mine opening.

It is not necessary or desirable that the reverse spray be be engaged until the mining machine has moved forward for a distance sufficient to place the reverse spray in front of the exhaust zone.

Figure 10:
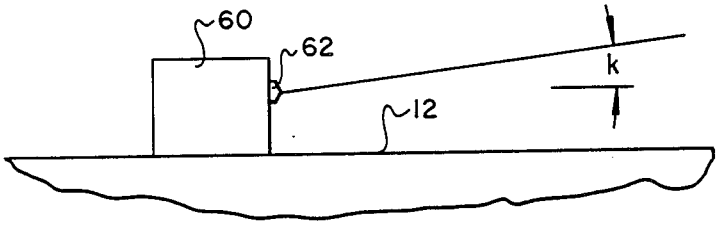
FIG. 10 is a schematic diagram of a spray block located on the top of the continuous mining machine showing the orientation of a sprayfan positioned in the spray block; and, FIG. 11 is a schematic diagram of the spray block of FIG. 10 further showing the orientation of a sprayfan positioned in the spray block.
Figure 11:
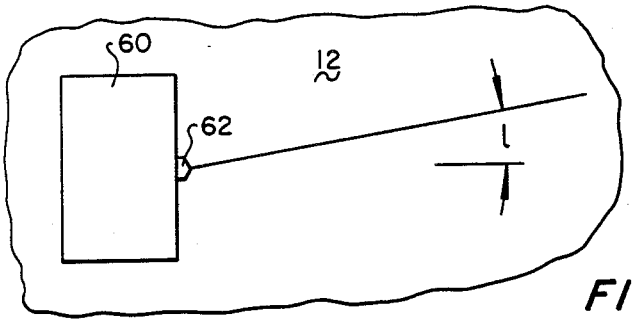

In a further embodiment of the improvment of the present invention, a cab spray is placed on top of mining machine 10 as shown in FIG. 6. Cab spray 60 is shown in FIG. 10 as well as sprayfan 62 which is oriented at an angle k from about 5° to about 25° from the top surface of mining machine body 12. As shown in FIG. 11, sprayfan 62 is oriented at an angle 1 from about 5° to about 25° from the horizontal axis of mining machine 10.

As discussed previously, the improvement of the present invention has been effective in extending the distance that the mining machine may advance safely beyond the curtain or exhaust zone. A series of tests conducted for Beaver Creek Coal Company by Foster-Miller under a contract with the United States Bureau of Mines has been completed and has found that the modified improved sprayfan system has the ability to ventilate the mine face at a forty foot exhaust zone (brattice or curtain) set back and that it will do so more effectively than the ventilating systems used prior to the development of the sprayfan system with a ten foot set back.

Having thus described the present invention by reference to its preferred embodiments, it is respectfully pointed out that many variations and modifications are possible within the scope of the present invention. Many such variations and modifications may appear obvious and desirable to those skilled in the art based upon a review of the foregoing description of preferred embodiments.

Having thus described the invention, I claim.

1. In a continuous mining machine equipped with a sprayfan ventilation system for methane and dust control, said sprayfan ventilation system including a plurality of sprayfan positioned on the front portion of said mining machine to produce a plurality of water sprays to direct intake air to and across the front of said mining machine to prevent buildup of methane and dust concentrations, said intake air containing methane and dust being thereafter discharged to an exhaust zone, an improvement comprising: at least one reverse sprayfan means mounted on a rear portion of said mining machine in a side of said mining machine nearest said exhaust zone and positioned to direct a water spray to the rear of said mining machine and to direct said intake air containing methane and dust generally toward said exhaust zone.

2. The improvement of claim 1 wherein said reverse sprayfan means comprises a sprayfan mounting block including two sets of sprayfans, each of said sets of sprayfans including at least one sprayfan.

3. The improvement of claim 2 wherein each of said sets of sprayfans include two sprayfans.

4. The improvement of claim 3 wherein a first set of sprayfans comprises an upper sprayfan positioned to spray at an angle from about 5° to about 25° above horizontal and a lower second sprayfan positioned to spray at an angle from about 5° to about 25° below horizontal.

5. The improvement of claim 5 wherein said first sprayfan and said second sprayfan are positioned to spray at an angle from about 5° to about 25° from a longitudinal axis of said mining machine.

6. The improvement of claim 3 wherein a second set of sprayfans comprises an upper third sprayfan positioned to spray at an angle from about 5° to about 25° above horizontal and a lower fourth sprayfan positioned to spray at an angle from about 5° to about 25° below horizontal.

7. The improvement of claim 6 wherein said third sprayfan and said fourth sprayfan are positioned at an angle from about 40° to about 50° from a longitudinal axis of said mining machine.

8. The improvement of claim 1 wherein an additional sprayfan means is positioned on said rear portion of said mining machine and on a side of said mining machine opposite said exhaust zone to direct said intake air toward said front portion of said mining machine.

9. The improvement of claim 8 wherein said additional sprayfan means comprises a set containing an upper fifth sprayfan positioned to spray at an angle from about 5° to about 25° above horizontal and at an angle from about 5° to about 25° from a longitudinal axis of said mining machine and a lower sixth sprayfan positioned to spray at an angle from about 5° to about 25° below horizontal and at an angle from about 5° to about 25° from said longitudinal axis of said mining machine.

10. The improvement of claim 8 wherein a cab sprayfan is positioned on said rear portion of said mining machine and on the top of said mining machine to spray to direct said intake air above said mining machine and toward said front portion of said mining machine.

11. The improvement of claim 1 wherein spray blocks are positioned on each side of said rear portion of said mining machine and wherein each of said spray blocks includes a reverse sprayfan means and an additional sprayfan means to direct said intake air toward said front portion of said mining machine.

12. In a method for removing methane and dust from a mine area during operation of a continuous mining machine, by spraying water through a plurality of sprayfans positioned on the front of said mining machine to direct intake air toward and across the front of said mining machine and exhausting said intake air containing said methane and dust from said mining area, an improvement comprising: spraying water through a reverse sprayfan positioned on a rear portion of said mining machine in a generally conical pattern toward the rear of said mining machine and generally toward an exhaust zone to direct said intake air containing said methane and dust toward said exhaust zone.

13. The improvement of claim 12 wherein a plurality of reverse sprays are used.

14. The improvement of claim 13 wherein a first reverse spray is directed at an angle from about 5° to about 25° above horizontal and wherein a second reverse spray is directed at an angle from about 5° to about 25° below horizontal.

15. The improvement of claim 13 wherein said first reverse spray and said second reverse spray are directed outwardly from a longitudinal axis of said mining machine at an angle from about 5° to about 25° from said longitudinal axis when said mining machine is operating on the side of said mining area nearest said exhaust zone.

16. The improvement of claim 14 wherein said first reverse spray and said second reverse spray are directed outwardly from a longitudinal axis of said mining machine at an angle from about 4° to about 50° from said longitudinal axis when said mining machine is operating on the side of said mining area opposite said exhaust zone.

17. The improvement of claim 12 wherein water is sprayed in a generally conical pattern generally toward the front of said mining machine through a forward sprayfan positioned on a rear portion of said mining machine and on a side of said mining machine opposite said exhaust zone.

18. The improvement of claim 17 wherein a plurality of forward sprays are used.

19. The improvement of claim 18 wherein a first forward spray is directed at an angle from about 5° to about 25° above horizontal and a second forward spray is directed at an angle from about 5° to about 25° below horizontal.

20. The improvement of claim 19 wherein said first forward spray and said second forward spray are directed outwardly from a longitudinal axis of said mining machine at an angle from about 5° to about 25° from said longitudinal axis.

21. The improvement of claim 12 wherein water is sprayed in a generally conical pattern generally toward the front of said mining machine from a spray fan positioned on a rear portion of and on top of said mining machine to direct said intake air generally toward the front of said mining machine.

* * * * *

UNITED STATES PATENT OFFICE

CERTIFICATE OF CORRECTION

PATENT NO. : 4,632,462

DATED : December 30, 1986

INVENTOR(S) : William M. Poling

It is certified that error appears in the above-identified patent and that said Letters Patent are hereby corrected as shown below:

In column 6, line 28, "sprayfan" should read --sprayfans--.

In column 8, line 12, "4°" should read --40°--.

Signed and Sealed this

Tenth Day of March, 1987

*Attest:*

DONALD J. QUIGG

*Attesting Officer*

*Commissioner of Patents and Trademarks*